US007257346B2

(12) United States Patent
Lyu et al.

(10) Patent No.: US 7,257,346 B2
(45) Date of Patent: Aug. 14, 2007

(54) FUSING ROLLER REGENERATING APPARATUS IN IMAGE FORMING APPARATUS AND METHOD THEREOF

(75) Inventors: Se-hyun Lyu, Seoul (KR); Jin-soo Lee, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 18 days.

(21) Appl. No.: 10/442,290

(22) Filed: May 21, 2003

(65) Prior Publication Data

US 2004/0037586 A1 Feb. 26, 2004

(30) Foreign Application Priority Data

Aug. 21, 2002 (KR) ..... 2002-49568

(51) Int. Cl.
*G03G 15/20* (2006.01)

(52) U.S. Cl. ..... 399/109; 399/333; 427/140

(58) Field of Classification Search ..... 399/109, 399/320, 325, 328, 330, 333; 118/60, 70, 118/409, 416; 264/36.12, 130; 29/895.1; 427/140, 413, 407.1

See application file for complete search history.

(56) References Cited

U.S. PATENT DOCUMENTS 3,796,183 A * 3/1974 Thettu ..... 118/70
4,426,953 A * 1/1984 Kromm et al. ..... 118/60
4,568,275 A * 2/1986 Sakurai ..... 432/60
4,705,388 A * 11/1987 Huntjens et al. ..... 399/24
5,839,041 A * 11/1998 Condello et al. ..... 399/325
5,840,416 A * 11/1998 Repo ..... 428/323
6,011,573 A * 1/2000 Nagahamaya et al. ..... 347/217
6,312,817 B1 * 11/2001 Chen et al. ..... 428/447
6,395,444 B1 * 5/2002 Riehle et al. ..... 430/124

FOREIGN PATENT DOCUMENTS

JP 61158362 A * 7/1986
JP 2000056602 A * 2/2000
JP 2000-347526 12/2000

* cited by examiner

*Primary Examiner*—Robert Beatty
(74) *Attorney, Agent, or Firm*—Staas & Halsey LLP

(57) ABSTRACT

A fusing roller regenerating apparatus of a fusing device in an image forming apparatus includes a coating unit coating a fusing roller using a dip coating method to form a regenerated coating layer to a predetermined thickness, and a heating unit including a heating body spaced apart from a surface of the fusing roller by a predetermined distance to harden the regenerated coating layer formed on the fusing roller by the coating unit. A method of regenerating the fusing roller includes injecting a coating liquid into the coating liquid tub through a coating liquid injection portion to form the regenerated coating layer to the predetermined thickness by rotating the fusing roller after the injection of the coating liquid, hardening the regenerated coating layer using the heating body, and discharging a remaining portion of the coating liquid through the coating liquid discharging portion after the hardening of the regenerated coating layer. The fusing roller regenerating apparatus in the image forming apparatus and a method thereof are capable of regenerating a new outer silicone coating layer of the fusing roller when an old outer silicone coating layer is contaminated, damaged or worn out, thereby reducing maintenance costs and waste of resources that are caused by a replacement of the expensive fusing device.

36 Claims, 5 Drawing Sheets

FUSING ROLLER REGENERATING APPARATUS IN IMAGE FORMING APPARATUS AND METHOD THEREOF

CROSS-REFERENCE TO RELATED APPLICATIONS

This application claims the benefit of Korean Application No. 2002-49568, filed Aug. 21, 2002, in the Korean Intellectual Property Office, the disclosure of which is incorporated herein by reference.

BACKGROUND OF THE INVENTION

1. Field of the Invention

The present invention relates to a fusing device in an image forming apparatus, such as a laser beam printer, a multi-function machine, a photocopier, or the like, and more particularly, to an apparatus for and a method of regenerating an outer coating layer of a fusing roller of a fusing device in an image forming apparatus when the outer coating layer is contaminated, damaged, or worn out.

2. Description of the Related Art

A general image forming apparatus using an electrophotographic developing method, such as a photocopier, a laser beam printer or the like, prints a desired image on a sheet of paper by the following processes, i.e., by electric charging, light exposure, developing, transferring, and fusing operations. The electric charging operation is to electrically charge a surface of a photosensitive drum by rotating an electrostatic charging roller disposed adjacent to the photosensitive drum. The light exposure operation is to scan the surface of the photosensitive drum with a laser beam projected from a laser scanning unit (LSU) to thus form an electrostatic latent image on the surface of the photosensitive drum. The developing operation is to develop the electrostatic latent image formed on the surface of the photosensitive drum to a toner image of a powdery state, i.e., a visible image, by supplying toner to the surface of the photosensitive drum. The transferring operation is to transfer the toner image formed on the photosensitive drum to a recording medium i.e., to the paper passing between the photosensitive drum and a transferring roller being in contact with the photosensitive drum with a predetermined pressure, while a predetermined transferring voltage is supplied to the transferring roller and the photosensitive drum. In the fusing operation, a fusing device including a fusing roller heats the paper with the toner image being transferred thereon, fuses the toner image of the powdery state to a liquid state, and settles down the toner image onto the paper.

Generally employed as a heating source of the fusing device is a halogen lamp. The halogen lamp is disposed inside the fusing roller and a fusing backup roller to heat surfaces of the fusing roller and the fusing backup roller to a predetermined temperature with a radiant heat, thereby fusing the toner image onto the paper.

FIG. 1 schematically shows an example of a fusing device 10 of a general electrophotographing image forming apparatus.

The fusing device 10 includes a fusing roller 1 that has a first metal core 4 shaped in a cylinder and a first heater 3*a*. A surface of the first metal core 4 is coated with a silicone rubber having an anti-adhesiveness to form a silicone coating layer 5. The first heater 3*a* is disposed in a center of the first metal core 4 and uses a halogen lamp, thereby generating radiant heat inside the first metal core 4. Accordingly, the first metal core 4 is heated by the radiant heat from the first heater 3*a*.

Under the fusing roller 1 is disposed a fusing backup roller 2 that includes a second metal core 15 shaped in a cylinder, and a second heater 3*b* disposed in a center of the second metal core 15 and using a halogen lamp. The fusing backup roller 2 is resiliently supported by a spring (not shown) so that it presses a sheet of printing paper 11 passing between the fusing roller 1 and the fusing backup roller 2 toward the fusing roller 1 with a predetermined pressure.

Also, under the fusing backup roller 2 is disposed an agent supplier 8 formed of Teflon to supply an agent 7 having a function of releasing the printing paper 1. Also, a blade 9 is disposed under the fusing backup roller 2 to evenly supply the agent 7 to the fusing backup roller 2.

Accordingly, while the printing paper 11 passes between the fusing roller 1 and the fusing backup roller 2, the toner image 14 formed on the printing paper 1 in a powdery state is subjected to a predetermined pressure and a predetermined heat. Due to the pressure and the heat applied on the fusing roller 1 and the fusing backup roller 2, the toner image 14 is fused onto the printing paper 11 at a nip 12 formed between the fusing roller 1 and the fusing backup roller 2.

Each of the fusing roller 1 and the fusing backup roller 2 is provided with a thermistor 6 and a thermostat (not shown) respectively disposed at a side thereof. The thermistor 6 is for detecting surface temperatures of the fusing roller 1 and the fusing backup roller 2 in an electrical signal form, and the thermostat blocks a power from being supplied to a heating unit, such as the first or second heater 3*a*, 4*b*, when the surface temperatures of the fusing roller 1 and the fusing backup roller 2 exceed a given threshold.

The thermistor 6 detects the surface temperatures of the fusing roller 1 and the fusing backup roller 2 and transmits the detected result (temperature) to a controller of the image forming apparatus. The controller regulates a power supply to the first and the second heaters 3*a* and 3*b* according to the detected temperature, thereby maintaining the surface temperatures of the fusing roller 1 and the fusing backup roller 2 within a given range.

The thermostat also functions as an overheat preventing unit to protect the fusing roller, the fusing backup roller 2 and their neighboring components in a case that the thermistor 6 and the controller fail to regulate the surface temperature of the fusing roller 1 and the fusing backup roller 2.

However, in the conventional fusing device 10 as described above, since the toner image 14 is fused onto the printing paper 11 due to the heat and the pressure applied on the fusing roller 1 and the fusing backup roller 2, if the fusing operation repeats for a long time, the coating layer 5 of the fusing roller 1 fusing the toner image onto the printing paper 11 is contaminated with the toner image 14 and thus an image quality deteriorates.

In order to prevent the image quality deterioration caused by the contamination of the coating layer 5, conventional methods have been suggested. One method is for coating the coating layer 5 of the fusing roller 1 with anti-adhesive oil to improve an anti-adhesiveness of the coating layer 5 and simultaneously projecting visible light or infrared light onto the coating layer 5 to dissolve a contaminated material into a low molecular oxide, such as dioxide carbon, water, or the like, and thus remove the contaminated material. The other method suggests a cleaning device of the fusing roller 1 to clean the fusing roller 1 in a standby mode for a predetermined time and coat the coating layer of the fusing roller with the anti-adhesive oil, thereby preventing the image quality deterioration. The former method is disclosed in Japanese Publication No. H12-347526, and the latter one is disclosed in Japanese Publication No. H13-125417.

The above cleaning devices may remove contaminants from the fusing roller 1 by cleaning the coating layer 5 of the fusing roller 1, but the cleaning devices cannot remove the contaminants when the coating layer 5 deteriorates, and thus the fusing roller 1 is damaged due to a long time use. In this case, it is inevitable that the fusing device 1 has to be entirely replaced with a new one to maintain the image quality.

As described above, since a life span of the conventional fusing device depends on the coating layer of the fusing roller, when the coating layer is damaged, the fusing device has to be replaced with a new one even when components other than the coating layer operate in a normal condition. Accordingly, there occur problems of waste of resources and increased maintenance costs.

SUMMARY OF THE INVENTION

The present invention has been developed in order to solve the above and/or other problems occurring in the related art. Accordingly, an aspect of the present invention is to provide a fusing roller regenerating apparatus in an image forming apparatus and a method thereof capable of regenerating an outer coating layer of a fusing roller of a fusing device in the image forming apparatus when the outer coating layer is contaminated, damaged or worn out, thereby reducing maintenance costs and waste of a resource that are caused by a replacement of the expensive fusing device.

Additional aspects and advantages of the invention will be set forth in part in the description which follows and, in part, will be obvious from the description, or may be learned by practice of the invention.

The above and/or other aspects of the present invention is achieved by providing a fusing roller regenerating apparatus of a fusing device in an image forming apparatus. The fusing roller regenerating apparatus includes a fusing roller having a coating layer formed on a surface thereof and having an anti-adhesiveness to fuse a toner image transferred to a sheet of printing paper onto the sheet, and a fusing backup roller pressing the sheet and the toner image formed thereon with respect to the fusing roller with a predetermined pressure. The fusing roller is disposed under the fusing backup roller, and the fusing roller generating apparatus includes a coating unit disposed under the fusing roller in a shape to partially enclose at least a lower portion of the fusing roller, to coat the fusing roller using a dip coating method to form a regenerated coating layer to a predetermined thickness, and a heating unit including a heating body spaced apart from a surface of the fusing roller by a predetermined distance, to harden the regenerated coating layer formed on the fusing roller by the coating unit.

According to another aspect of the present invention, the coating unit includes a coating liquid tub having a semi-circular cylinder shaped receiving portion disposed to receive the lower portion of the fusing roller and having a predetermined space with respect to the fusing roller, a coating liquid injection portion disposed at a side of an upper portion of the coating liquid tub to inject a coating liquid into the coating liquid tub, and a coating liquid discharging portion disposed in a bottom of the semi-circular cylinder shaped receiving portion to discharge a coating liquid that remains after a coating process.

It is possible that the coating unit includes a storing container storing a remainder coating liquid discharged through the coating liquid discharging portion.

The heating body includes a short-distance infrared heater and adjusts the predetermined distance between the short-distance infrared heater and the regenerated coating layer of the fusing roller so as to regulate a hardening temperature of the regenerated coating layer, and the heating unit further includes a reflecting mirror reflecting heat of the short-distance infrared heater onto a surface of the regenerated coating layer of the fusing roller to increase a thermal efficiency of the short-distance infrared heater.

According to another aspect of the present invention, a method of regenerating a fusing roller in an image forming apparatus includes a fusing roller having a coating layer formed on a surface thereof and having an anti-adhesiveness to fuse a toner image transferred to a sheet of printing paper onto the sheet, a fusing backup roller disposed on an upper portion of the fusing roller to press the sheet and the toner image formed thereon with respect to the fusing roller with a predetermined pressure, a coating unit including a coating liquid tub disposed under the fusing roller and formed in a shape to partially receive at least a first portion of the fusing roller, a coating liquid injection portion injecting a coating liquid into the coating liquid tub, and a coating liquid discharging portion discharging the coating liquid from the coating liquid tub, and a heating unit including a heating body spaced-apart from a surface of the fusing roller by a predetermined distance. The method of regenerating the fusing roller includes injecting a coating liquid into the coating liquid tub through the coating liquid injection portion, forming a regenerated coating layer to a predetermined thickness by rotating the fusing roller after the injection of the coating liquid, hardening the regenerated coating layer by the heating body, and discharging a remainder coating liquid through the coating liquid discharging portion after the hardening of the regenerated coating layer.

The injecting of the coating liquid into the coating liquid tub includes injecting the coating liquid mainly formed of a silicone rubber material into the coating liquid tub. It is possible that the injecting of the coating liquid into the coating liquid tub includes injecting the coating liquid mainly having either a fluorine resin or a fluorine rubber into the coating liquid tub.

The forming of the regenerated coating layer in the predetermined thickness includes forming the regenerated coating layer ranging from 150 μm to 200 μm in thickness. Here, a thickness of the regenerated coating layer is adjusted by a cohesive property of the coating liquid.

The hardening of the regenerated coating layer includes performing the hardening at a temperature ranging from 160° C.-180° C. for about 15 minutes while slowly rotating the fusing roller with respect to the coating liquid tub. Here, the hardening temperature of the regenerated coating layer is regulated by adjusting a distance between the heating body and the regenerated coating layer of the fusing roller.

Also, the hardening of the regenerated coating layer includes using a short-distance infrared heater as the heating body, and providing a reflecting mirror in the short-distance infrared heater to reflect heat of the short-distance infrared heater toward the regenerated coating layer of the fusing roller so as to increase a thermal efficiency.

According to another aspect of the present invention, a fusing roller regenerating apparatus of a fusing device fusing a toner image on a sheet of paper in an image forming apparatus includes a fusing roller having a heater, a core disposed around the first heater, and a first coating layer formed on the core and having an anti-adhesiveness, a fusing backup roller pressing the sheet having the toner image against the fusing roller to fuse the toner image onto the sheet when the sheet having the toner image passes between the fusing backup roller and the first coating layer of the fusing roller, a coating unit coating a liquid on the first coating layer, and a heating unit hardening the liquid to form a second coating layer of the first coating layer.

According to another aspect of the present invention, a fusing roller regenerating apparatus of a fusing device fusing a toner image on a sheet of paper in an image forming apparatus includes a fusing roller having a heater, a core disposed around the first heater, a first coating layer formed on the core and having a first anti-adhesiveness, and a second coating layer formed on the first coating layer and having a second anti-adhesiveness, and a fusing backup roller disposed above the fusing roller to rotate while being contact with one of the first and second coating layers.

According to another aspect of the present invention, a method in a fusing roller regenerating apparatus of a fusing device fusing a toner image on a sheet of paper in an image forming apparatus includes causing a fusing roller having a heater, a core disposed around the first heater, and a first coating layer formed on the core and having an anti-adhesiveness to be disposed below a fusing backup roller to fuse the toner image onto the sheet when the sheet having the toner image passes between the fusing backup roller and the first coating layer of the fusing roller, coating a liquid on the first coating layer, and hardening the liquid to form a second coating layer of the first coating layer.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
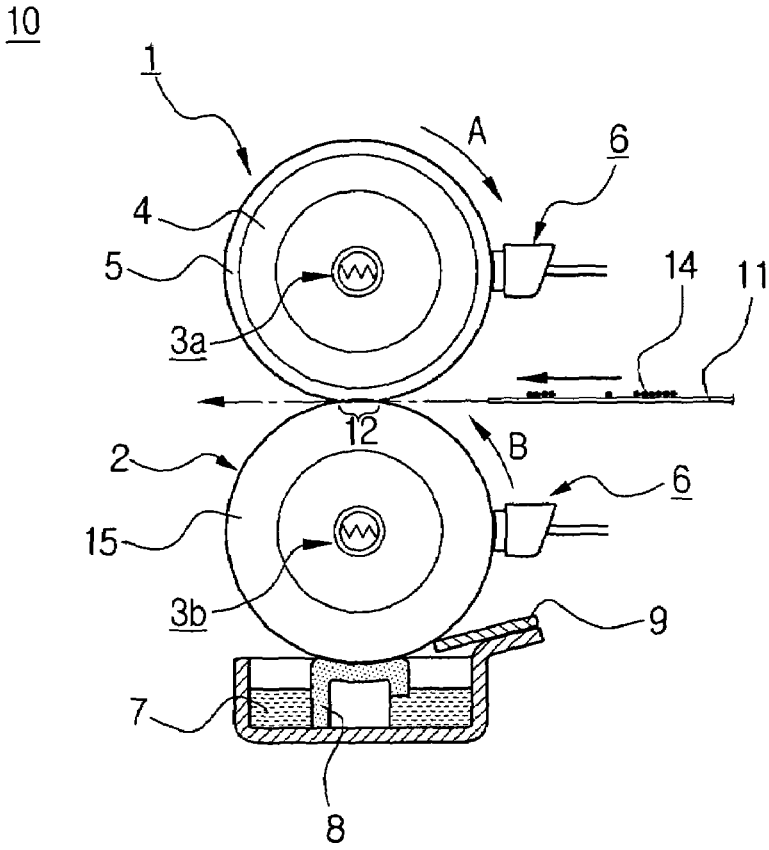
FIG. 1 (PRIOR ART)
FIG. 1 is a side section view schematically showing a fusing device in a conventional image forming apparatus.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Hereinafter, a fusing roller regenerating apparatus in an image forming apparatus and a method thereof will be described in greater detail with reference to the accompanying drawings.

Figure 2:
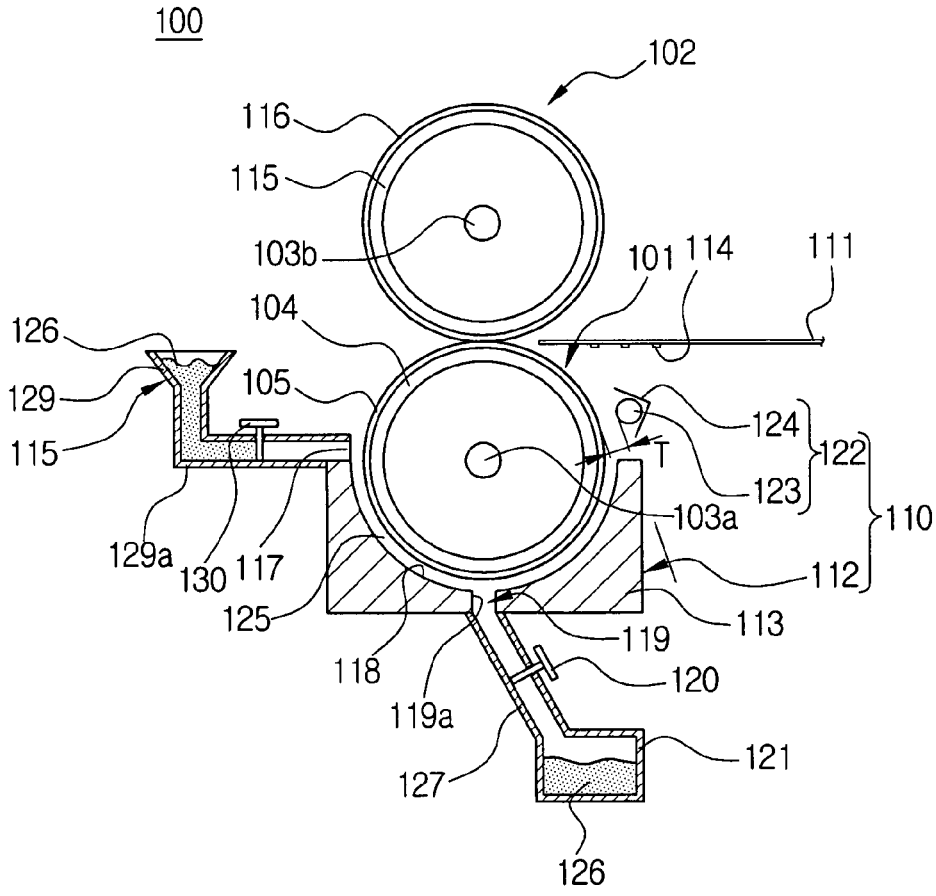
FIG. 2 is a side section view schematically showing a fusing device in an image forming apparatus employing a fusing roller regenerating apparatus according to an embodiment of the present invention.

FIG. 2 schematically shows a fusing device 100 of an image forming apparatus employing a fusing roller regenerating apparatus 110 according to an embodiment the present invention.

To fuse a toner image 114 transferred to a sheet of printing paper 111 onto the sheet 111, the fusing device 100 of the image forming apparatus includes a fusing roller 101 that includes a cylinder-shaped first metal core 104 and a first heater 103*a* disposed at a center of the first metal core 104. A surface of the first metal core 104 is coated with a silicone rubber material having an anti-adhesiveness so that a first silicone coating layer 105 is formed on the surface of the first metal core 104 to a predetermined thickness, for example, 3 mm.

The first metal core 104 includes a metal pipe made of stainless steel, copper, aluminum, or the like, having a high thermal conductivity so that the first metal core 104 is easily heated by radiant heat emitted from the first heater 103*a*.

The first heater 103*a* uses a halogen lamp and has both ends connected to a voltage supply terminal (not shown) of an AC controller (not shown) supplying an electric current, thereby generating the radiant heat inside the first metal core 104.

On an upper portion of the fusing roller 101 is disposed a fusing backup roller 102 having of a cylinder-shaped second metal core 115 and a second heater 103*b* disposed at a center of the second metal core 115. A surface of the second metal core 115 is coated with the silicone rubber material to improve the anti-adhesiveness with respect to the sheet 111 so that a second silicone coating layer 116 is formed on the surface of the second metal core 115 to another predetermined thickness, for example, 1 mm.

The second metal core 115 includes a metal pipe made of stainless steel, copper, aluminum or the like, having a high thermal conductivity so that the second metal core 115 is easily heated by the radiant heat emitted from the second heater 103*b*.

The second heater 103*b* uses the halogen lamp and has both ends connected to the voltage supply terminal (not shown) of the AC controller (not shown) supplying the electrical current, thereby generating the radiant heat inside the second metal core 115.

The fusing backup roller 102 is resiliently supported by a spring (not shown) so that the fusing backup roller 102 presses the sheet 111 passing between the fusing roller 101 and the fusing backup roller 102 toward the fusing roller 101 with a predetermined pressure.

At sides of the fusing roller 101 and the fusing backup roller 102 are provided a thermistor (not shown) detecting surface temperatures of the fusing roller 101 and the fusing backup roller 102 in an electrical signal form and a thermostat (not shown) blocking a power from being supplied to the first or second heater 103*a*, 103*b*, when the surface temperatures of the fusing roller 101 and the fusing backup roller 102 exceed a given threshold.

Also, under the fusing roller 101 is disposed the fusing roller regenerating apparatus 110. The fusing roller regenerating apparatus 110 regenerates the first silicone coating layer 105 of the fusing roller 101 when the first silicone coating layer 105 is damaged.

The fusing roller regenerating apparatus 110 includes a coating unit 112 and a heating unit 122. The coating unit 112 is disposed under the fusing roller 101 and encloses a lower portion of the fusing roller 101 to coat the first silicone coating layer 105 to form a regenerated coating layer 128 (Refer to FIG. 3A). The heating unit 122 is disposed apart from the surface of the first silicone coating layer 105 by a predetermined distance T to harden the regenerated coating layer 128 coated by the coating unit 112.

The coating unit 112 includes a coating liquid tub 113, a coating liquid injecting portion 115, a coating liquid discharging portion 119 and a storing container 121 to coat the first silicon coating layer 105 of the fusing roller 101 using a dip coating method to form the regenerated coating layer 128 ranging from 150 μm to 200 μm in thickness. The coating liquid tub 113 has a semi-circular cylinder shaped receiving portion 118 and is disposed under the fusing roller 101 to have a predetermined space 125 with the fusing roller 101. The coating liquid injecting portion 115 is disposed at a side of an upper portion of the coating liquid tub 113 to eject a coating liquid 126 into the coating liquid tub 113, and the coating liquid discharging portion 119 is disposed in a bottom of the receiving portion 118 to discharge a remaining portion of the coating liquid 126. The storing container 121 stores the remaining portion of the coating liquid 126.

The coating liquid injecting portion 115 includes a coating liquid injection guide portion 129 having an injection pipe 129*a* and a solenoid valve 130. The injection pipe 129*a* temporarily stores the coating liquid 126 and has an injection port 117 connected to an upper portion of the coating liquid tub 113 to allow the coating liquid 126 to flow into the coating liquid tub 113. The solenoid valve 130 is disposed in the injection pipe 129*a* to regulate an amount of the coating liquid 126 to be injected.

The coating liquid discharging portion 119 includes a discharging port 119*a* disposed in a bottom of the receiving portion 118 of the coating liquid tub 113, a discharging pipe 127 connecting the discharging port 119*a* and the storing container 121 to discharge the coating liquid 126 therethrough, and a discharge regulating solenoid valve 120 regulating the coating liquid 126 to be stored in the coating liquid tub 113 and to be discharged.

The heating unit 122 includes a short-distance infrared heater 123 disposed in a lengthwise direction of the fusing roller 101 to adjust the distance T with respect to the regenerated coating layer 128 formed on the first silicone coating layer 105 of the fusing roller 101 to regulate a hardening temperature of the regenerated coating layer 128, and a reflecting mirror 124 reflecting heat of the short-distance infrared heater 123 toward the regenerated coating layer 128 of the fusing roller 101 so as to improve a thermal efficiency of the short-distance infrared heater 123.

Hereinafter, descriptions will be made about a method of regenerating the first silicone coating layer 105 of the fusing roller 101 by using the fusing roller regenerating apparatus 110 of the image forming apparatus as constructed above with reference to FIG. 2 and FIGS. 3A to 3C.

After the solenoid valve 130 is opened to regulate injection of the coating liquid 126, and the solenoid valve 120 is closed to regulate discharging the coating liquid 126, the coating liquid 126 is injected into the coating liquid tub 113 through the coating liquid injection guide portion 129 of the injection portion 115. At this point, the coating liquid 126 uses a solution liquid mainly having a silicon rubber material and a hardening agent for the silicone rubber. Alternatively, the solution liquid used for the coating liquid 126 may include either a fluorine resin or a fluorine rubber, and the hardening agent.

After a space 125 between the first silicone coating layer 105 of the fusing roller 101 and the receiving portion 118 of the coating liquid tub 113 is filled with the coating liquid 126, the fusing roller 101 is rotated at a very slow speed in a single direction, for example, in a counterclockwise direction. Accordingly, the fusing roller 101 is coated with the coating liquid 126 having a cohesive property using a dip coating method so that the regenerated coating layer 128 is formed on the first silicone coating layer 105 to a predetermined thickness.

It is possible that, the regenerated coating layer 128 ranges from 150 μm to 200 μm in thickness. The thickness of the regenerated coating layer 128 can be adjusted by the cohesive property of the coating liquid 126.

Figure 3A:
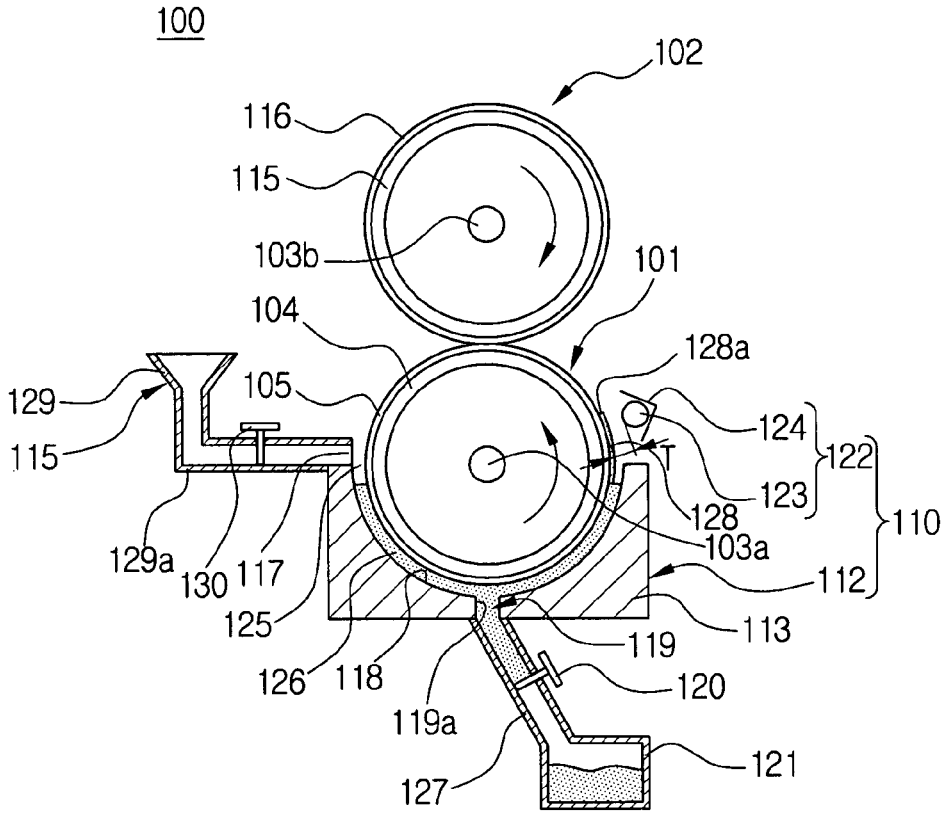
FIGS. 3A through 3C are side section views showing operations of the fusing roller regenerating apparatus of FIG. 2.

As shown in FIG. 3A, as the fusing roller 101 is rotated, a leading portion 128*a* of the regenerated coating layer 128 formed on the first silicone coating layer 105 of the fusing roller 101 approaches the short-distance infrared heater 123 disposed in the lengthwise direction of the fusing roller 101 and spaced-apart from the fusing roller 101 by the predetermined distance T. Then, the short-distance infrared heater 123 is turned-on to harden the leading portion 128*a* of the regenerated coating layer 128 approaching the short-distance infrared heater 123.

At this time, the hardening of the regenerated coating layer 128 is performed at a hardening temperature ranging from 160° C. to 180° C. for about 15 minutes. The hardening temperature of the regenerated coating layer 128 can be regulated depending on the predetermined distance T between the short-distance infrared heater 123 and the regenerated coating layer 128 of the fusing roller 101.

Also, in order to improve the thermal efficiency during the hardening of the regenerated coating layer 128, the reflecting mirror 124 is disposed to deflect the heat of the short-distance infrared heater 123 toward the regenerated coating layer 128 of the fusing roller 101.

As described above, when the hardening of the leading portion 128*a* of the regenerated coating layer 128 which is disposed to be in close contact with the short-distance infrared heater 123, is completed, the other portions of the regenerated coating layer 128 adjacent to the leading portion 128*a* are hardened by the short-distance infrared heater 123 under the same condition as that of the leading portion 128*a*.

Figure 3B:
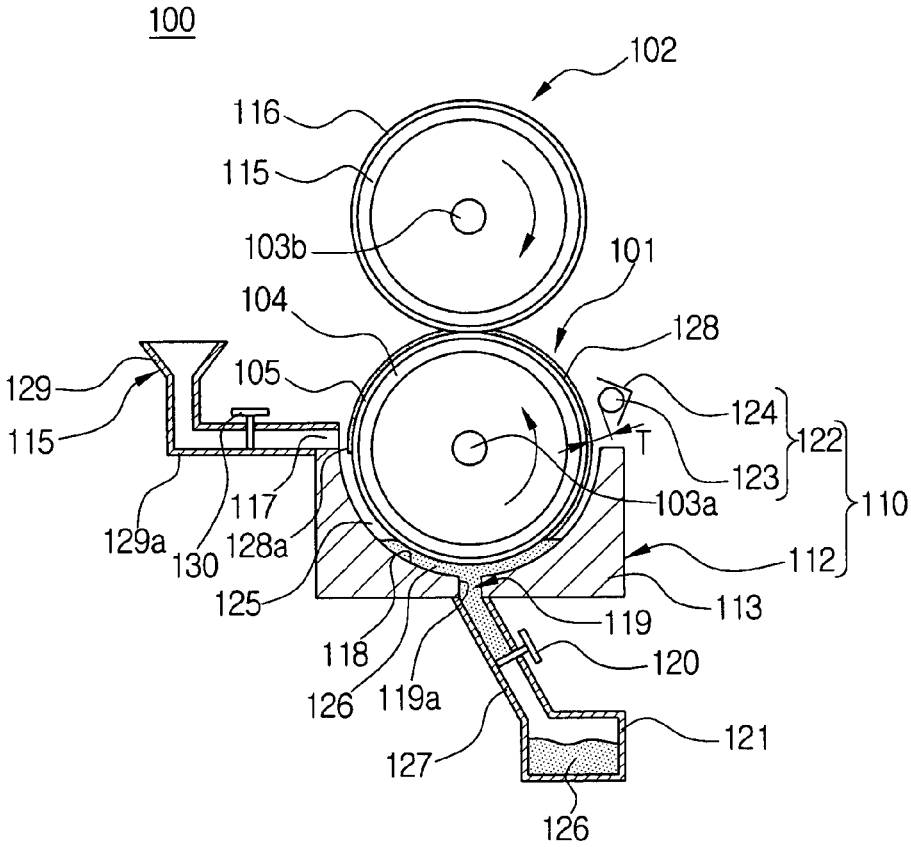

As shown in FIG. 3B, the hardening of the regenerated coating layer 128 slowly proceeds with the fusing roller 101 rotating in the counter-clockwise direction at the very slow speed.

Figure 3C:
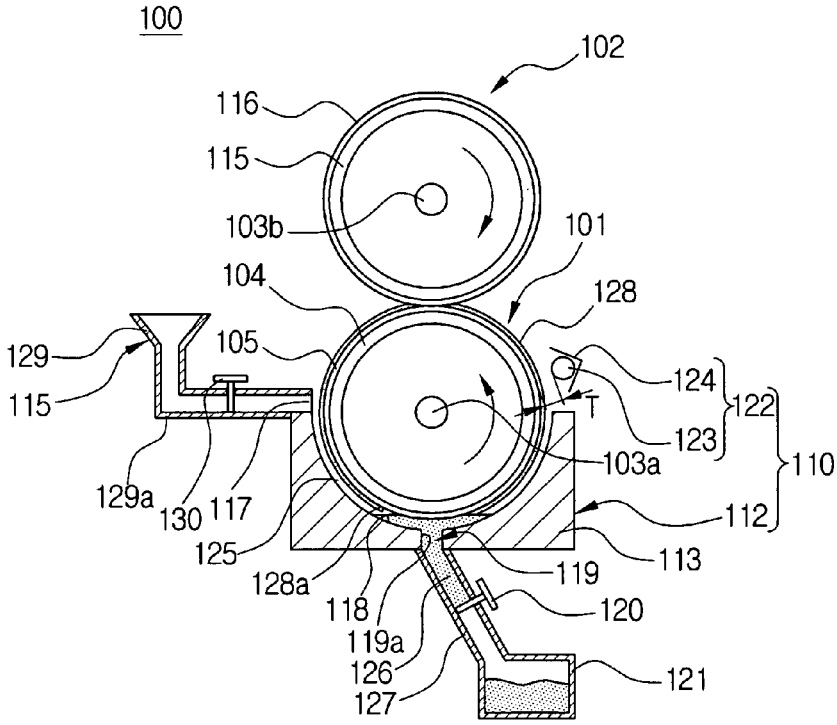

After that, as shown in FIG. 3C, when the firstly hardened leading portion 128*a* of the regenerated coating layer 128 reaches the coating liquid 126, which remains in the receiving portion 118, and then dips into the coating liquid 126, the discharge regulating solenoid valve 120 of the coating liquid discharge portion 119 is opened and the remaining portion of the coating liquid 126 is discharged into the storing container 121 through the discharging pipe 127.

After the remaining portion of the coating liquid 126 is discharged, a portion of the regenerated coating layer 128 which is not hardened proceeds in the hardening process by a rotation of the fusing roller 10 using the short-distance infrared heater 123. As this portion of the regenerated coating layer 128 is completely hardened, the regenerating operation of the fusing roller regenerating apparatus is finished.

As described above, the fusing roller regenerating apparatus in the image forming apparatus and a method thereof are capable of regenerating the outer silicone coating layer of the fusing roller when the outer silicone coating layer is contaminated, damaged or worn out, thereby reducing maintenance costs and waste of resources that are caused by a replacement of the expensive fusing device.

The foregoing embodiment and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

What is claimed is:

1. A fusing roller regenerating apparatus of a fusing device in an image forming apparatus, comprising:

a fusing roller having a coating layer formed on a surface thereof and having an anti-adhesiveness to fuse a toner image transferred to a sheet of printing paper onto the sheet; and a fusing backup roller pressing the sheet and the toner image formed thereon with respect to the fusing roller with a predetermined pressure;

wherein the fusing roller is disposed under the fusing backup roller, and the fusing roller regenerating apparatus comprises, a coating unit disposed under the fusing roller in a shape to partially enclose at least a lower portion of the fusing roller to coat the fusing roller to form a regenerated coating layer to a predetermined thickness, and a heating unit including a heating body spaced-apart from a surface of the fusing roller by a predetermined distance to harden the regenerated coating layer formed on the fusing roller by the coating unit.

2. The fusing roller regenerating apparatus of claim 1, wherein the coating unit comprises:

a coating liquid tub having a semi-circular cylinder shaped receiving portion disposed to receive the lower portion of the fusing roller and having a predetermined space with the fusing roller;

a coating liquid injection portion disposed at a side of an upper portion of the coating liquid tub to inject a coating liquid into the coating liquid tub; and a coating liquid discharging portion disposed in a bottom of the semi-circular cylinder shaped receiving portion to discharge a remaining portion of the coating liquid that remains after a coating process.

3. The fusing roller regenerating apparatus of claim 2, wherein the coating unit comprises:

a storing container storing the remaining portion of the coating liquid discharged through the coating liquid discharging portion.

4. The fusing roller regenerating apparatus of claim 1, wherein:

the heating body comprises, a short-distance infrared heater, the predetermined distance between the short-distance infrared heater and the regenerated coating layer of the fusing roller being adjusted to regulate a hardening temperature of the regenerated coating layer; and the heating unit further comprises, a reflecting mirror reflecting heat of the short-distance infrared heater onto a surface of the regenerated coating layer of the fusing roller to increase a thermal efficiency of the short-distance infrared heater.

5. A method of regenerating a fusing roller in an image forming apparatus, the method comprising:

causing a coating unit including a coating liquid tub to be disposed under the fusing roller and formed in a shape to partially receive the fusing roller the coating unit having, a coating liquid injection portion and a coating liquid discharging portion;

causing a heating unit including a heating body to be spaced-apart from a surface of the fusing roller by a distance;

injecting the coating liquid into the coating liquid tub through the coating liquid injection portion;

forming a regenerated coating layer to a predetermined thickness by rotating the fusing roller after the injection of the coating liquid;

hardening the regenerated coating layer using the heating body; and discharging a remaining portion of the coating liquid through the coating liquid discharging portion after the hardening of the regenerated coating layer.

6. The method of claim 5, wherein the injecting of the coating liquid into the coating liquid tub comprises:

injecting the coating liquid having a silicone rubber material into the coating liquid tub.

7. The method of claim 5, wherein the injecting of the coating liquid into the coating liquid tub comprises:

injecting the coating liquid having one of a fluorine resin and a fluorine rubber into the coating liquid tub.

8. The method of claim 5, wherein the forming of the regenerated coating layer to the predetermined thickness comprises:

forming the regenerated coating layer ranging from 150 μm to 200 μm in thickness.

9. The method of claim 8, wherein the forming of the regenerated coating layer to the predetermined thickness comprises:

adjusting a thickness of the regenerated coating layer by a cohesive property of the coating liquid.

10. The method of claim 5, wherein the hardening of the regenerated coating layer comprises:

performing the hardening at a hardening temperature ranging from 160° C.-180° C. for about 15 minutes while slowly rotating the fusing roller with respect to the coating liquid tub.

11. The method of claim 10, wherein the hardening of the regenerated liquid layer comprises:

regulating the hardening temperature of the regenerated coating layer by adjusting the distance between the heating body and the regenerated coating layer of the fusing roller.

12. The method of claim 10, wherein the heating body comprises a short distance infrared heater, and the hardening of the regenerated coating layer comprises:

causing a reflecting mirror disposed adjacent to the short-distance infrared heater to deflect heat of the short-distance infrared heater toward the regenerated coating layer of the fusing roller so as to increase a thermal efficiency.

13. The method of claim 5, wherein the heating body comprises a short distance infrared heater, and the hardening of the regenerated coating layer comprises:

causing a reflecting mirror disposed adjacent to the short-distance infrared heater to deflect heat of the short-distance infrared heater toward the regenerated coating layer of the fusing roller so as to increase a thermal efficiency.

14. A fusing roller regenerating apparatus of a fusing device fusing a toner image on a sheet of paper in an image forming apparatus, comprising:

a fusing roller having a heater, a core disposed around the first heater, and a first coating layer formed on the core and having an anti-adhesiveness;

a fusing backup roller pressing the sheet having the toner image against the fusing roller to fuse the toner image onto the sheet when the sheet having the toner image passes between the fusing backup roller and the first coating layer of the fusing roller;

a coating unit coating a liquid on the first coating layer; and a heating unit hardening the liquid to form a second coating layer of the first coating layer.

15. The fusing roller regenerating apparatus of claim 14, wherein the coating unit is disposed opposite to the fusing backup roller with respect to the fusing roller.

16. The fusing roller regenerating apparatus of claim 14, wherein the fusing roller is disposed below the fusing backup roller.

17. The fusing roller regenerating apparatus of claim 14, wherein the coating unit is disposed below the fusing roller.

18. The fusing roller regenerating apparatus of claim 14, wherein the coating unit is spaced-apart from the first coating layer of the fusing roller by a first distance.

19. The fusing roller regenerating apparatus of claim 14, wherein the coating unit supplies the liquid to an outer surface of the first coating layer of the fusing roller.

20. The fusing roller regenerating apparatus of claim 14, wherein the heating unit hardens the liquid supplied to the outer surface of the first coating layer of the fusing roller to form a second coating layer.

21. The fusing roller regenerating apparatus of claim 14, wherein the heating unit is spaced-apart from the first coating layer of the fusing roller by a second distance greater than the first distance.

22. The fusing roller regenerating apparatus of claim 14, wherein the heating unit is spaced-apart from the fusing roller by a distance, and the distance is variable.

23. The fusing roller regenerating apparatus of claim 14, wherein the heating layer generates heat so that a temperature of the liquid coating on the first coating layer ranges between 160° C. and 180° C. inclusive.

24. The fusing roller regenerating apparatus of claim 14, wherein the coating unit comprises a coating liquid tub having the same shape as a portion of the fusing roller in a radial direction with respect to a rotational axis of the fusing roller.

25. The fusing roller regenerating apparatus of claim 24, wherein the coating liquid tub has a bottom disposed on a line passing through centers of the fusing roller and the fusing backup roller.

26. The fusing roller regenerating apparatus of claim 14, wherein the coating unit comprises a coating liquid tub disposed below the fusing roller to form a space with the fusing roller, and the liquid fills the space between the coating liquid tub and the fusing roller.

27. The fusing roller regenerating apparatus of claim 26, wherein the liquid is coated on the first coating layer when the fusing roller rotates.

28. The fusing roller regenerating apparatus of claim 27, wherein the heating unit generates heat to harden the liquid coated on the first coating layer before the liquid coated on the first coating layer reaches the fusing backup roller.

29. The fusing roller regenerating apparatus of claim 14, wherein the fusing roller rotates a first speed when the toner image is fused on the paper, and a second speed when the liquid is coated and hardened on the first coating layer, and the second speed is slower than the first speed.

30. The fusing roller regenerating apparatus of claim 14, wherein the fusing roller rotates at a rotation speed slower than at least 15 minutes per a half rotation.

31. The fusing roller regenerating apparatus of claim 14, wherein the second coating layer has a thickness ranging between 150 μm and 200 μm inclusive.

32. A fusing roller regenerating apparatus of a fusing device fusing a toner image on a sheet of paper in an image forming apparatus, comprising:

a fusing roller having a heater, a core disposed around the first heater, and a first coating layer formed on the core and having a first anti-adhesiveness;

a fusing backup roller pressing the sheet having the toner image against the fusing roller to fuse the toner image onto the sheet when the sheet having the toner image passes between the fusing backup roller and the first coating layer of the fusing roller;

a coating unit disposed adjacent a first portion of the fusing roller and containing a liquid to be applied to the first coating layer; and a heating unit disposed on a second portion of the fusing roller to harden the liquid.

33. The fusing roller regenerating apparatus of claim 32, wherein the fusing backup roller is disposed above the fusing roller.

34. The fusing roller regenerating apparatus of claim 33, wherein the paper comprises:

a first surface including the toner image and facing the fusing roller when passing between the through the fusing backup roller and the fusing roller; and a second surface facing the fusing backup roller.

35. The fusing roller regenerating apparatus of claim 34, wherein the paper passes between the fusing backup roller and the second coating layer of the fusing roller.

36. A method in a fusing roller regenerating apparatus of a fusing device fusing a toner image on a sheet of paper in an image forming apparatus, comprising:

causing a fusing roller having a heater, a core disposed around the first heater, and a first coating layer formed on the core and having an anti-adhesiveness to be disposed below a fusing backup roller to fuse the toner image onto the sheet when the sheet having the toner image passes between the fusing backup roller and the first coating layer of the fusing roller;

coating a liquid on the first coating layer; and hardening the liquid to form a second coating layer on the first coating layer.

* * * * *

UNITED STATES PATENT AND TRADEMARK OFFICE

CERTIFICATE OF CORRECTION

PATENT NO. : 7,257,346 B2
APPLICATION NO. : 10/442290
DATED : August 14, 2007
INVENTOR(S) : Se-hyun Lyu et al.

It is certified that error appears in the above-identified patent and that said Letters Patent is hereby corrected as shown below:

Column 11, Line 2, change “of” to --on--.

Column 12, Line 33, after “between” delete “the through”.

Signed and Sealed this

Eighteenth Day of December, 2007

JON W. DUDAS
*Director of the United States Patent and Trademark Office*